United States Patent [19]

Laszlo et al.

[11] 4,039,795

[45] Aug. 2, 1977

[54] APPARATUS FOR TRANSPORTING MATERIALS FOR TREATMENT OF SAID MATERIALS IN A MICROWAVE UNIT

[75] Inventors: Tibor S. Laszlo; Osvalds F. Licis, both of Richmond, Va.

[73] Assignee: Philip Morris Incorporated, New York, N.Y.

[21] Appl. No.: 634,520

[22] Filed: Nov. 24, 1975

Related U.S. Application Data

[63] Continuation-in-part of Ser. No. 506,042, Sept. 16, 1974, abandoned.

[51] Int. Cl.[2] ..... H05B 9/06

[52] U.S. Cl. ..... 219/10.55 A; 198/560

[58] Field of Search ..... 219/10.55 R, 10.55 A, 219/10.55 F, 10.55 D; 198/102, 190, 46

[56] References Cited

U.S. PATENT DOCUMENTS

| | | | |
|---|---|---|---|
| 3,050,606 | 8/1962 | Tibbs | 219/10.55 A |
| 3,151,230 | 9/1964 | Britton | 219/10.55 A |
| 3,564,187 | 2/1972 | Smith | 219/10.55 A |
| 3,590,493 | 7/1971 | Gretz | 198/190 X |
| 3,665,141 | 5/1972 | Schiffmann et al. | 219/10.55 A |
| 3,665,491 | 5/1972 | Cooper | 219/10.55 A |
| 3,699,899 | 10/1972 | Schiffman et al. | 219/10.55 A |
| 3,699,976 | 10/1972 | Abe et al. | 219/10.55 M |
| 3,725,628 | 4/1973 | Johnson | 219/10.55 A |

FOREIGN PATENT DOCUMENTS

| | | | |
|---|---|---|---|
| 43-16951 | 4/1965 | Japan | 219/10.55 A |
| 4,529,155 | 8/1966 | Japan | 219/10.55 A |
| 1,197,885 | 7/1970 | United Kingdom | 219/10.55 A |

*Primary Examiner*—Arthur T. Grimley

*Attorney, Agent, or Firm*—Watson, Leavenworth, Kelton & Taggart

[57] ABSTRACT

Apparatus for transporting materials to, from and through the cavity of a microwave unit is disclosed, said apparatus embodying microwave energy cut-off means which is effective to prevent any undue microwave leakage from escaping therethrough. The apparatus in one form comprises a transporter unit which includes an endless transporter belt means disposed in a housing connected to the microwave unit, the transporter belt means feeding the material being treated onto and receiving treated material from a further conveyor unit within the microwave unit, the belt means traversing tunnels in the housing which function as cut-off tubes to prevent microwave leakage from the cavity of the microwave unit, the tunnels having a cross-sectional configuration and length such as to provide for the desired degree of power attenuation. For example, for a microwave unit operating at 2450 MHz the tunnels can be square and have a maximum or longest side dimension of about 1.7 inches and a length of about 10 inches. In another form of the apparatus, the materials being treated are carried through the microwave unit on a plurality of belts, there being cutoff tunnels associated with the plurality of belts and connected to the microwave unit structure at the location where the belts make entry and exit from the microwave unit.

14 Claims, 7 Drawing Figures

APPARATUS FOR TRANSPORTING MATERIALS FOR TREATMENT OF SAID MATERIALS IN A MICROWAVE UNIT

CROSS REFERENCE TO RELATED APPLICATIONS

This application is a continuation-in-part of pending application Ser. No. 506,042 filed Sept. 16, 1974, now abandoned.

BACKGROUND OF THE INVENTION

It is known to subject various materials to microwave energy in the cavity of a microwave unit for various purposes, e.g., it being known to employ such technique in connection with the treatment of tobacco in cut fiber or shred form for expanding the same. Presently employed apparatus for this purpose usually includes a conveyor belt to transport the material to and from the cavity, together with a choke at inlet and outlet to absorb any microwaves leaking from these openings, which energy if the openings are large enough for practical operating volumes, will otherwise usually far exceed the safe value of 10mw/cm² at a distance of 2 inches established by the Bureau of Radiological Health, U.S. Dept. of Commerce. The choke is made up of energy-absorbing materials that are cooled by flowing water thereto to carry away the heat. Such an arrangement is expensive to install and to operate. Further it does not always give the required protection as shown in Table 1, from Eure, John A., James W. Nicolls, and Robert L. Elder, Am. J. Public Health, 62, 157377, December 1972.

A second disadvantage of such known system is that the microwave energy that passes through the cavity opening and is absorbed in the choke represents an energy loss or deviation from the intended purpose of the microwave cavity operation. This loss can be a significant fraction of the total energy supplied to the cavity. Such a loss can be prevented, however, by the application of the cut-off tube principle, viz., if, in a wave guide with perfectly conducting walls, a possible mode of transmission is excited at a frequency that is below cut-off for that particular mode, no energy will be transmitted through the guide from the point of excitation. This type of waveguide or cut-off tube does not require water cooling because it does not absorb any microwave energy. Such waveguides or cutoff tubes as are effective to the intended purpose generally are of relatively small cross-section so that such a cutoff tube will not allow passage of most shredded or fibrous particulate matter, even in a vertical position unless some form of material conveying assistance is provided. Accordingly, it is desirable that a more effective means of conveying material into the microwave unit be provided, but yet such means as embodies therewith an effective means of prevention of microwave energy escape to the environment outside the microwave unit.

SUMMARY OF THE INVENTION

The present invention relates to an apparatus for feeding material to be subjected to microwave treatment to, from and through the cavity of a microwave unit. It is particularly intended for use in a continuous operation of the microwave unit involving continuous transport of material to, from and through the said cavity. While the invention is described in terms particular to the treatment of cut or shredded tobacco filler material, it will be apparent that it can be used for transporting any type of particulate material which is to be treated in a microwave unit.

In accordance with one embodiment of the present invention, protective transporter apparatus is adapted to be mounted on the casing of a microwave unit over an opening in the casing through which the material is intended to enter or leave the microwave cavity, the transporter apparatus including a housing which extends outwardly a distance from the casing opening. Located within the housing are a pair of drums, one an idler drum located at the end of the housing connected to the casing and adjacent the cavity opening, with the other or power driven drum being located adjacent the other end of the housing. A plurality of transporter belts are mounted on the two drums and traverse endless travel courses within the housing, with the housing having two pairs of opposed side walls, the belts being disposed such that their endless travel course includes straight course runs adjacent to and spaced from the inner surface of one of said pairs of housing side walls. In traversing their endless travel courses, the belts generally are disposed substantially parallel one with the others and to maintain such parallel relation between the respective belts, one of the drums, the driven drum, is provided with radial flanges which are disposed between adjacent ones of the belts. Further to facilitate the transport of material by the belts, the belts may be provided with upstanding lugs spaced along the lengths of the belts.

Means are provided within the housing to define with the inner wall surfaces of the said pair of opposed housing side walls, a corresponding plurality of pairs of tunnels of rectangular cross section associated one pair of tunnels with each belt and which each said belt traverses during the respective straight course runs thereof, with the longest side dimension of each tunnel cross section being not greater than a predetermined length and the tunnel length also being of predetermined value, these parameters being associated with the microwave energy attenuation desired with respect to a particular microwave excitation. Such parameters can readily be determined by those skilled in the art. The tunnels which extend between the two drums conveniently can be provided from partitions which extend inwardly from the inner surfaces of said housing side walls alongside the straight run courses of the belts and panels which extend between the said partitions and which are disposed substantially parallel to the said inner wall surfaces with the belt straight run courses being disposed intermediate the said panels and the said opposed wall inner surfaces. Inasmuch as the tunnel cross section is limited to having a longest side dimension selected with respect to achieving optimized microwave attenuation, the tunnel functions as a cut-off tube to restrict or prevent microwave leakage outwardly of the housing.

In accordance with the invention, the tunnel cross sectional configuration conveniently could be rectangular or square rectangular provided the longest side of the cross section is not greater than a given value, e.g., about 1.7 inches for an approximately 10 inch long tunnel functioning as a waveguide for an excitation of 2450MHz. The belts which are employed within the housing preferably are provided from a material which has high microwave energy transmission characteristics, such materials including polytetrafluoroethylene, glass fiber silicone-rubber, or any other low-loss material. Further, the invention provides means for adjusting tension in said belts while retaining the feature that the belts travel in tunnels functioning as cut-off tubes.

The transporter apparatus also may include a microwave reflector which is supported within the housing adjacent the idler drum and following the contour of said drum in spaced relation therewith, the deflector being located at the side of the drum remote from the adjacent end of the housing.

In another embodiment of the apparatus of the present invention, a plurality of endless course, side-by-side arranged belts traverse a course which passes into, through and out of a microwave unit, material to be treated being subjected to microwave energy while on the belts. At the location where the endless belts enter and exit from the microwave unit, waveguide tunnel assemblies are connected to the microwave unit structure, the respective belts being associated with and passing through the respective ones of the tunnels in each tunnel assembly. While traversing the microwave unit, the belts have horizontal runs and the belts can be provided as flexible shaped structures of generally U-shaped section, the belts having sidewalls which are slit at spaced longitudinal locations to facilitate their passage around and over course charge pulleys in the endless travel course.

The invention accordingly comprises the features of construction, combination of elements, and arrangement of parts, which will be exemplified in the construction hereafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings in which.

DESCRIPTION OF THE PREFERRED EMBODIMENTS

The present invention is concerned with apparatus for transporting material to be subjected to microwave energy to, through and from a microwave cavity. The invention is described in representative embodiment as being applicable to vegetable material and particularly tobacco. It will be appreciated, however, that its principles are applicable to any treatment procedure involving continuous transport of a material or products into, through and out of a microwave cavity. With respect to microwave field frequencies to which the invention is applicable, the same can vary over wide ranges of such frequencies, and waveguide parameters can readily be determined for any selected frequency. At the present time in accordance with existing FCC regulations, four frequencies are available for industrial purposes. These frequencies are 22,000; 5800; 2450; and 915 MHz and specific utilization of several of these as well as waveguide parameters associated therewith will be given later on in the description.

Figure 1:
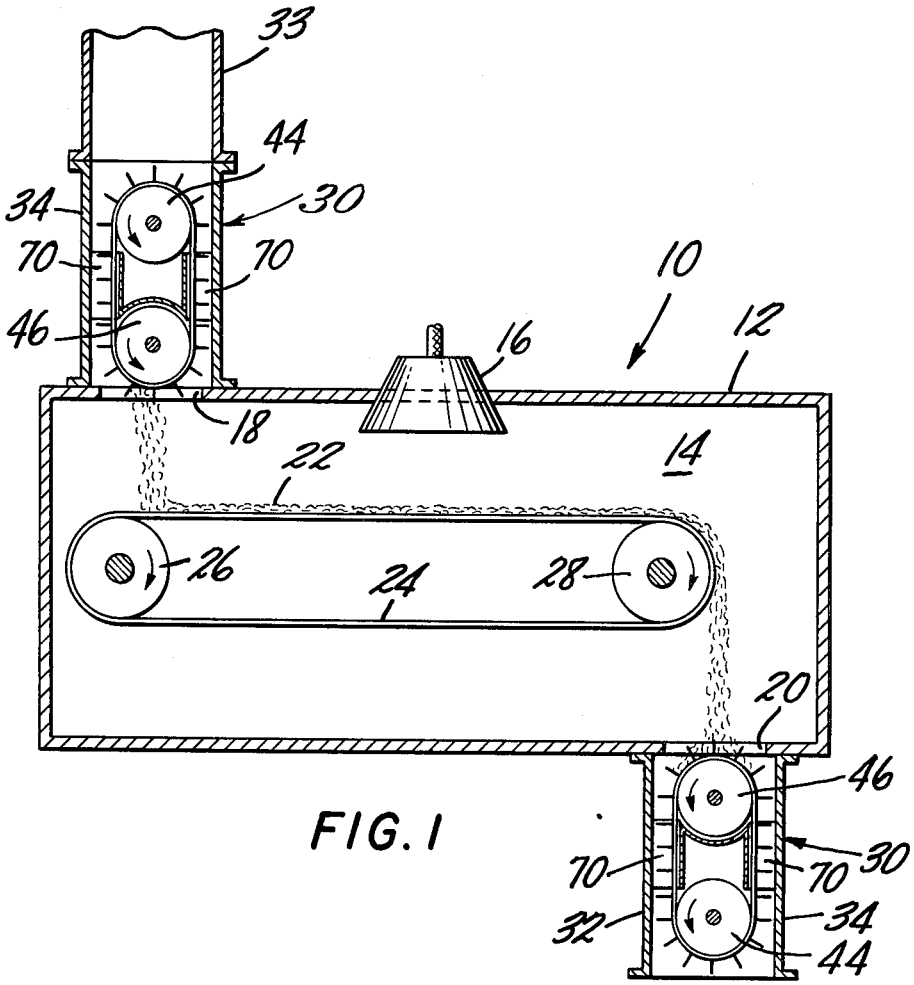
FIG. 1 is a longitudinal vertical sectional view of improved microwave unit apparatus for subjecting material to microwave energy, the unit including one form of protective transporter apparatus provided in accordance with the present invention.

Referring now to FIG. 1, there is depicted apparatus 10 for microwave treatment of material, for example, shredded or cut tobacco filler which is to be subjected to microwave energy as an incident of expanding the same, e.g., as described in U.S. Pat. No. 3,842,846. Such apparatus 10 includes a casing or microwave unit 12, which is an elongated structure enclosing a cavity 14 into which the material is introduced to subject it to microwave energy. A suitable energy source or exciter shown generally at 16 is mounted at the upper part of the casing 12. The casing 12 is provided with an entry opening 18 and an exit opening 20 through which the material can be delivered to and withdrawn from the microwave cavity 14. Entrance opening 18 conveniently is located adjacent one end of the casing so that the tobacco material 22 can be deposited therethrough onto a moving endless conveyor belt 24 traversing an endless travel course within cavity 14 between roller drums 26 and 28, with the material being transported through the cavity and ultimately discharged from the belt 24 at the right end of the casing from whence it is delivered through opening 20 for removal from the casing. The apparatus also includes at the entry and discharge openings protective transporter units 30 which will be described in greater detail below, the transporter units 30 being employed to effectively eliminate any microwave energy leakage through the openings 18 and 20. An input hopper 33 can be connected with the protective transporter unit 30 at the entry to the cavity for supplying the material in known manner to the transporter and ultimately delivery into the microwave unit.

Figure 2:
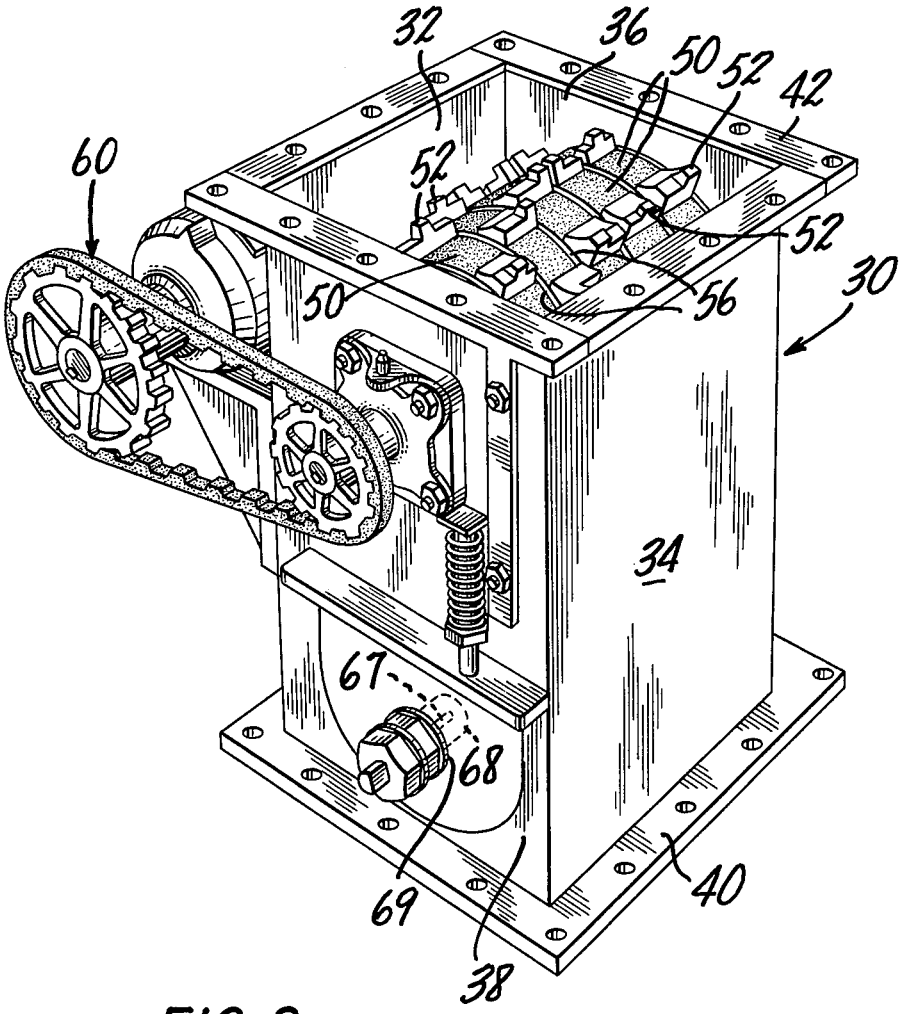
FIG. 2 is a perspective view of the protective transporter apparatus shown at the inlet and outlet openings of the microwave apparatus depicted in FIG. 1.
Figure 3:
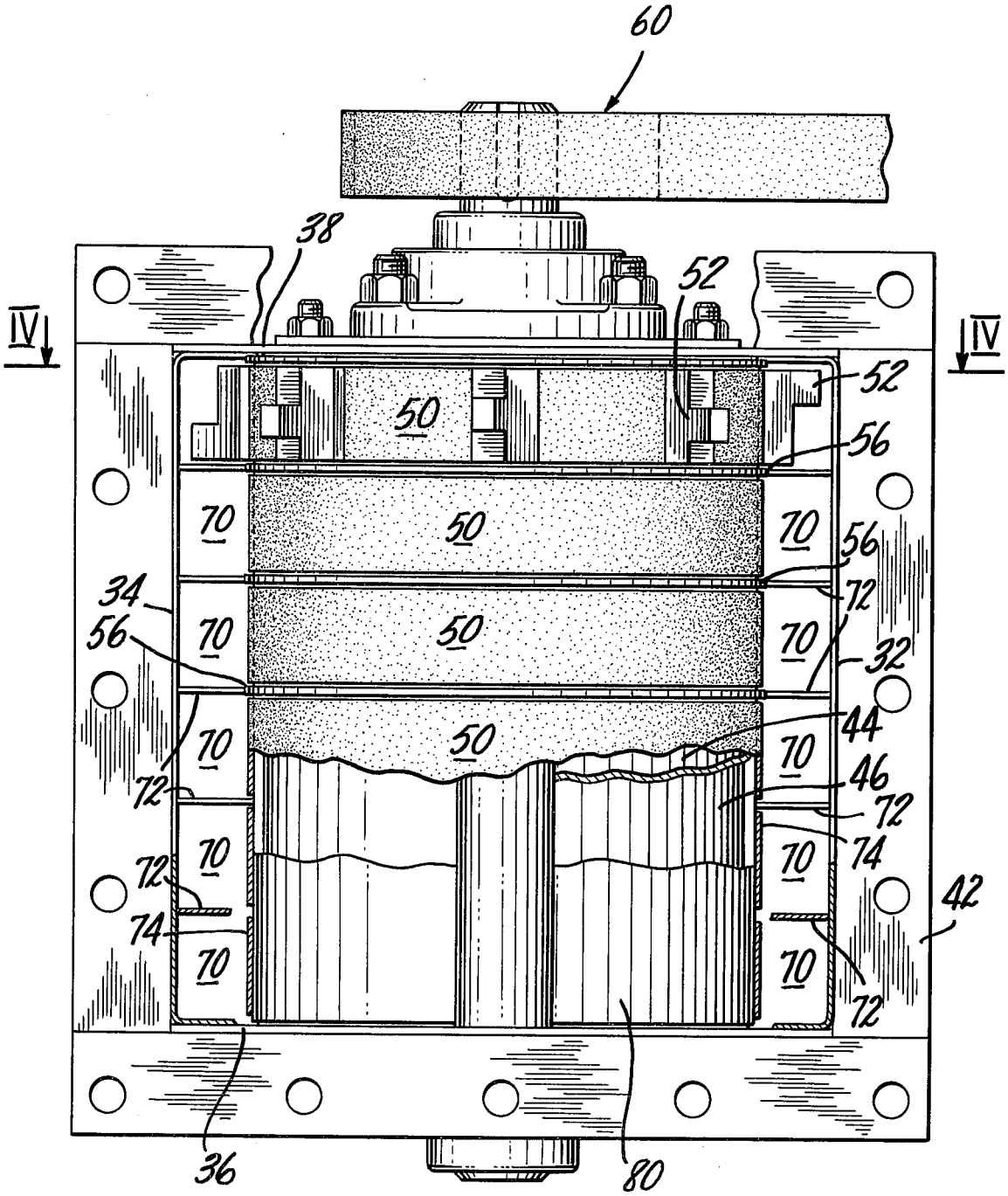
FIG. 3 is a top plan view with portions broken away of the protective transporter apparatus depicted in FIG. 2.
Figure 4:
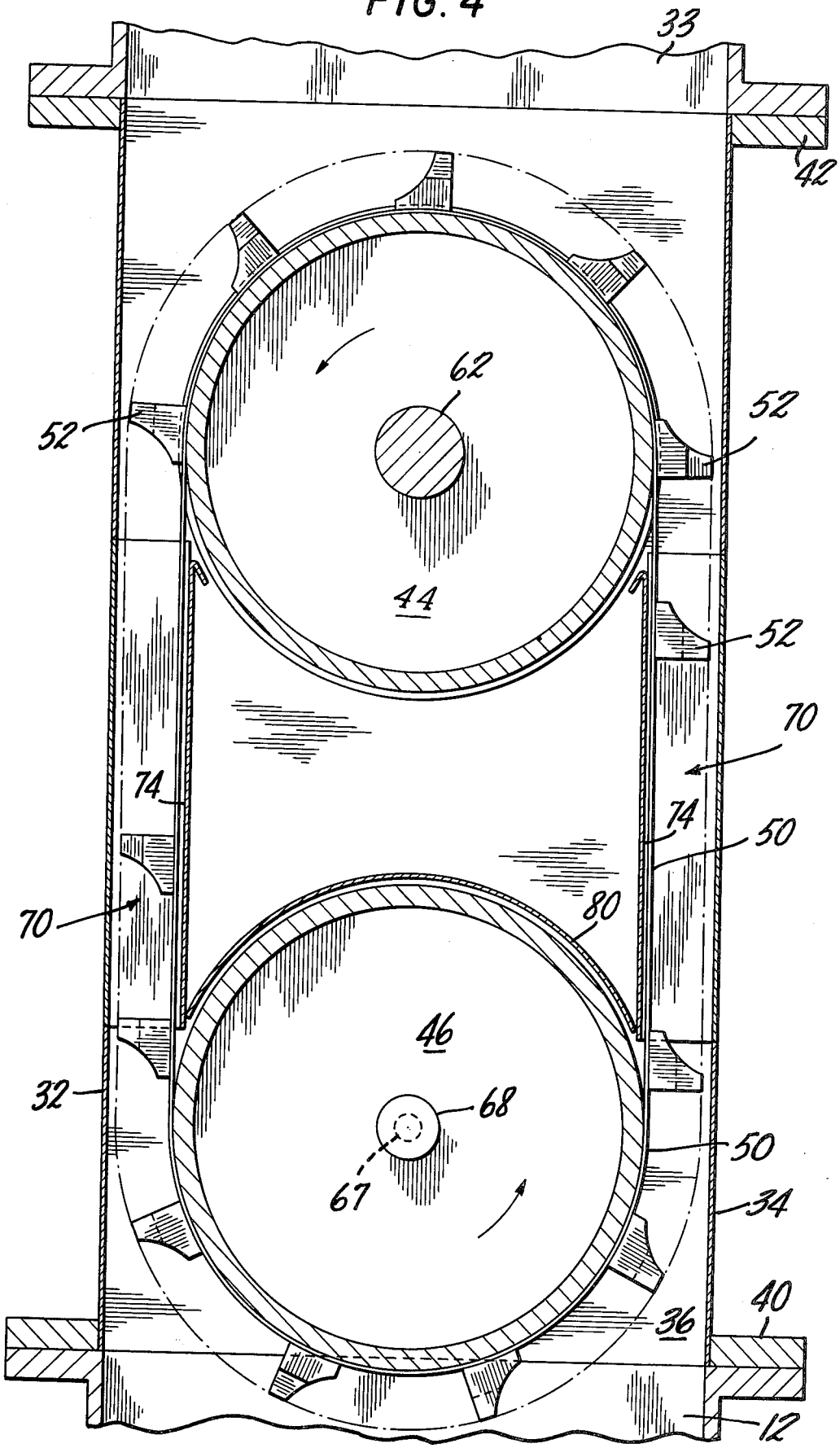
FIG. 4 is a vertical sectional view as taken along the line IV—IV in FIG. 3.

Turning now to FIGS. 2–4, the protective transporter unit 30 comprises an elongated housing which is connected at one of its ends to the microwave unit over the associated cavity with the housing including four side walls 32, 34, 36 and 38, the side walls being arranged in opposed pairs of such walls with the inner surfaces of the walls being of relatively smooth configuration and such that each wall inner surface is in parallel spaced disposition with an opposite side wall inner surface, the configuration of housing desirably being generally rectangular. At one end of the housing 30 there is provided a flange 40 with which the housing can be connected to the microwave unit. The opposite housing end also includes a flange 42 which can be used for a like purpose, for example, in connecting an input hopper unit 33 at the entrance to the transporter unit.

Disposed within the transporter unit housing are a pair of drums 44 and 46 which provide means for supporting a plurality of endless belts 50 for travel through an endless travel course within the housing, the belts in the depicted embodiment traversing straight course runs adjacent to and spaced from opposed side walls, 32 and 34. The belts also may be provided with a series of upstanding lugs 52 at spaced locations along the length of each belt, the plurality of belts further being arranged to travel in generally parallel travel courses within the housing and drum 44 being provided with radial flanges 56 disposed between adjacent ones of the belts to maintain them in such parallel disposition. The drum 44 which is remote from the end of the housing that is connected to the microwave cavity, is a driven unit and for such purpose suitable driving mechanism as at 60 can be provided, the shaft 62 associated with drum 44 being rotatably mounted in the other pair of opposed side walls 36, 38. Idler drum 46 which also is rotatably supported in the housing desirably is electrically insulated from the structure of the walls 36 and 38 and to that end drum 46 is at the opposite ends provided with bushings 68 of electrically insulative material, as for example, polytetrafluoroethylene or other suitable polymer material which are rotatably received on fixed pins 67 carried on the housing walls, the fixed pins being part of the fixed structure generally depicted at 69.

In accordance with the present invention, and to attenuate or reduce microwave leakage to any but inconsequential values, the housing is provided with pairs of tunnels 70 associated one pair each with one of the belts so that during the straight course run of the belt it will travel through the pair of tunnels, with the tunnels having for a commercially feasible application thereof, a rectangular cross section the longest side dimension of which is not greater than a predetermined value, e.g., with respect to 2450 MHz a longest side dimension of 1.7 inches. Further the tunnels 70 desirable also have a length of a predetermined value depending on the particular frequency, so that for 2450MHz, such length would be at 30 KW power output, at least about 10 inches. As can be best seen in FIG. 4, the tunnels 70 extend between the two drums 44, 46 and are comprised of partitions 72 extending inwardly from the opposed side walls 32, 34 at substantially a right angle therewith with the partitions extending alongside the straight run courses of the belts. Further panels 74 extend between the partitions and are disposed substantially parallel to and spaced from the inner surfaces of the walls 32, 34. The belts 50 as can be seen in FIG. 4 travel in their straight run courses intermediate the inner surfaces of the side walls 32, 34 and the panels 74. As indicated above, the cross sectional configuration and dimension of the tunnel as well as length thereof is selected such as to effectively produce a cut-off effect without the use of any special dielectric and in order to reduce microwave energy leakage to levels which are below 10 mw/cm$^2$ and desirably to a value below 5mw/cm$^2$.

As noted above, in a specific embodiment of tunnel 70 for establishing desired attenuation of 2450mHz excitation at 30KW power output, the tunnel if a rectangular waveguide should have a longest side dimension of about 1.7 inches and a length of about 10 inches to achieve attenuation to an energy leakage from the tunnel of below 10mw/cm$^2$. As will be evident to those skilled in the waveguide art, the rectangular waveguide cross-sectional dimensions and length may be varied to provide desired attenuation of frequencies other than 2450MHz excitation. Moreover, circular waveguides and waveguides of other cross-sectional configuration could be employed. Formulae for determining the cut-off wavelength of such a waveguide from its cross-sectional dimension and for selecting length to achieve desired attenuation of excitation wavelength exceeding such cutoff wavelength are known to those skilled in the art, e.g., being set forth at pages 617–628 of "Reference Data for Ratio Engineering," 4th Ed., 1956, published by the International Telephone and Telegraph Company, New York, NY. Thus, and by utilizing such formulae, one skilled in the art readily can determine that tunnels 70 if rectangular in cross-section and for an excitation at 30KW power output, should have a longest side dimension of 2.7 inches and a length of about 20 inches to achieve the desired attenuation with respect to a frequency of 915MHz.

With reference again to FIG. 4, the transporter unit 30 also is provided with a reflector 80 for reflecting microwave energy which said reflector is supported in the housing adjacent drum 46 and adjacent to the side of said drum remote from the end of the housing which is connected to the microwave cavity, with the reflector following closely the contour of the drum 46 and being disposed further in spaced relation therewith. The reflector extends substantially the full width of the housing between the side walls 36, 28.

In order to avoid heating the belts, it is desirable that the belts 50 be provided from a material which has low-loss characteristics and for this purpose material such as polytetrafluoroethylene, glass fiber and silicone rubber can be used for the belts. The structure of the housing desirably is made from any suitable metal as for example stainless steel or aluminum.

In an actual embodiment, the protective transporter 30 was employed to feed cut tobacco filler into a microwave cavity with 30KW power output at a frequency of 2450MHz. The feeding went smoothly and leakage from the top opening of the feeder was less than 5 mw/cm$^2$, measured at the top of tunnels 70.

Figure 5:
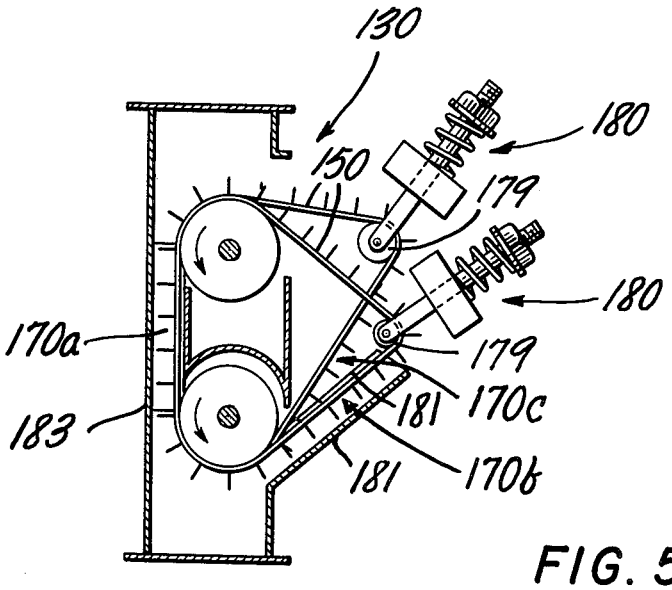
FIG. 5 is a schematic depiction of a modified form of the apparatus shown in FIGS. 1–5 which includes means for adjusting tension in the transporter belts.

FIG. 5 depicts a modified form of protective transporter unit 130 in which means are provided for adjusting the tension in each of the respective transporter belts 150. Thus the unit 130 includes tunnels **170*a* associated with the entry travel course run of the belt to the microwave cavity and tunnels 170*b*, 170*c* associated with the return travel course run tunnels to permit the belts to traverse a course around the pulleys 179 of tensioning units 180, the tunnels 170*b*, 170*c* otherwise being in all respects as to dimension and function, the same as earlier described. The side wall structure 181 of the housing is also disposed at an angle to the opposite wall structure 183, the structure 181 being for example provided in sections associated with each tunnel 170*b*, 170*c*. Thus each belt can be provided with its own tensioning control device without interfering with the purpose of providing effective cut-off tube means for attenuation of microwave energy passing through openings 18 and 20 of the unit 12.**

Figure 6:
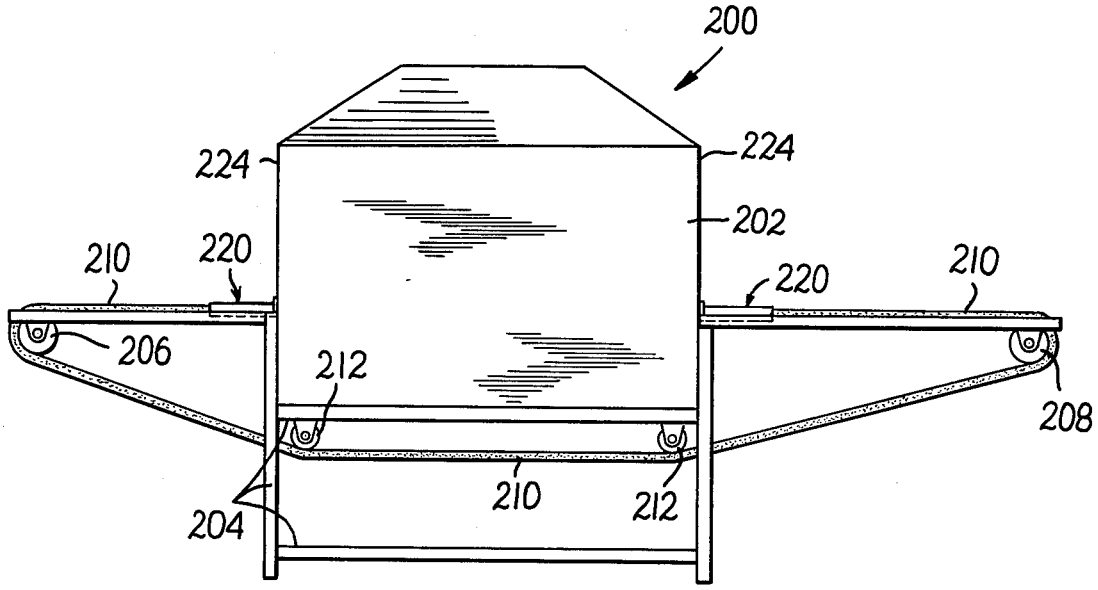
FIG. 6 is a side elevational view of another form of apparatus in which a single plurality of belts is employed for transporting the material into, through and out of the microwave unit, there being waveguide tunnel assemblies employed at the location of entry and exit of the belts from the microwave unit.
Figure 7:
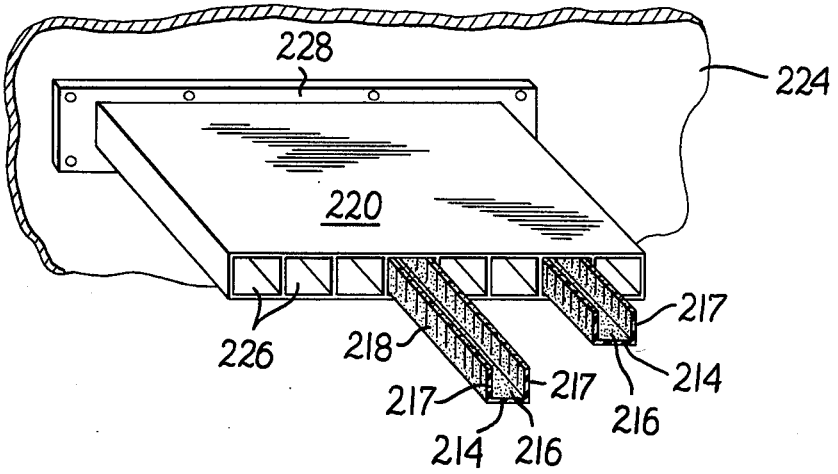
FIG. 7 is a fragmentary perspective view of one of the tunnel assemblies shown in the apparatus of FIG. 6.

FIGS. 6 and 7 depict a still further form of apparatus 200 with which a material such as tobacco can be subjected to microwave energy. The apparatus 200 includes a chambered structure 202 fitted interiorly with a microwave exciter (not shown) as well as supporting frame structure comprised of various interconnected vertical and horizontal members 204. Disposed exteriorly of chamber 202 at opposite ends thereof and supported in conventional manner by suitable structure are a pair of rollers 206, 208 and a conveyor belt means 210 traversing an endless travel course, a part of which is a straight horizontal course run between rollers 206, 208, the return travel course of the belt means being by way of guide rollers 212. Materials to be treated are deposited on belt means 210 at the left end of the apparatus and transported through the chamber 202 for treatment and the removal from the belt means at the right end in known manner.

As can be best seen in FIG. 7, the belt means comprises a plurality of separate parallel side-by-side arranged belts 214, each belt being of generally U-shaped or channel cross-section, each belt having a base 216 and opposed upright side walls 217. To facilitate transport of the belts 214 around rollers 206 and 208, the side walls 217 are slit at spaced longitudinal locations thus providing that the side walls comprise a succession of wall segments 218. Associated with the belt means are waveguide or tunnel assemblies 220 disposed at the locations in the opposite end walls 222, 224 of chamber 202 where the belts enter and exit the chamber, with a separate tunnel 226, e.g., of rectangular shape being associated with a separate one of two belts 214. The tunnel assemblies 220 are connected to the respective walls 222, 224, e.g., by means of a mounting frame 228, and each tunnel 226 is sized in known manner to provide the desired attenuation of microwave energy. Thus, each tunnel 226 if the involved microwave energy is at 30KW power output and 2450MHz, will have a longest side dimension of 1.7 inches and a length of about 10 inches.

While there is above disclosed but several embodiments of the transporter apparatus of the present invention, it will be apparent that various modifications can be made thereto without departing from the scope of the invention concept which has been disclosed.

What is claimed is:

1. In apparatus for treating particulate material and the like by subjecting it to microwave energy and including a casing enclosing a space defining a microwave cavity, a microwave power source exciting microwave energy within said casing, and means for conveying material to and from said cavity through openings in said casing, the improvement in which said conveying means comprises a plurality of separate belts, means for supporting said endless belts for travel in straight parallel travel courses communicating with said openings and passing through said casing, and an enclosure extending outwardly from each said casing opening, said enclosure comprising a corresponding plurality of separate elongated tunnels associated one with each of said belts and in which said belts travel during the straight course travel thereof, the tunnels being characterized by having waveguide characteristics and predetermined cross-sectional dimensions and length such as to effect attenuation of microwave energy therein to a level below 10mw/cm$^2$ at the tunnel ends remote from said casing openings, said enclosure comprising two opposed, parallel spaced walls, the straight run courses of said belts extending between said walls, there further being partitions extending between said walls at the sides of each belt to define with said opposed walls an assembly of separate tunnels of rectangular cross-section and each associated with one of said belts, said assembly being connected to said casing, said belts traversing horizontally disposed straight travel courses with said belts being of substantially U-shaped cross-section having a base and side walls upstanding from said base and passing through said tunnels in close spaced adjacency to the tunnel structure.

2. The apparatus of claim 1 in which each of said belts is provided with upstanding lugs at spaced locations along the length thereof.

3. The apparatus of claim 1 in which said conveyor belt means is made of a material which has low-loss characteristics.

4. The apparatus of claim 1 in which said microwave power source operates at 2450MHz and a power output of about 30KW, the longest side dimension of said tunnel cross-section being substantially 1.7 inches, said tunnels being about 10 inches long.

5. The apparatus of claim 1 in which said microwave power source operates at 915MHz and a power output of about 30KW, the longest side dimension of said tunnel cross-section being substantially 2.7 inches, said tunnels being about 20 inches long.

6. In apparatus for treating particulate material and the like by subjecting it to microwave energy and including a casing enclosing a space defining a microwave cavity, a microwave power source exciting microwave energy within said casing, and means for conveying material to and from said cavity through openings in said casing, the improvement in which said conveying means comprises a plurality of separate belts, means for supporting said endless belts for travel in straight parallel travel courses communicating with said openings, and an enclosure extending outwardly from each said casing opening, said enclosure comprising a corresponding plurality of separate elongated tunnels associated one with each of said belts and in which said belts travel during the straight course travel thereof, the tunnels being characterized by having waveguide characteristics and a predetermined cross-sectional dimensions and length such as to effect attenuation of microwave energy therein to a level below 10mw/cm$^2$ at the tunnel ends remote from said casing openings, said enclosure including a housing having two opposed inner wall surfaces, the belt supporting means being disposed in said housing and supporting said belts for travel in endless travel courses within said housing and with two oppositely directed straight course runs passing adjacent to and spaced from inner wall surfaces, there further being means defining with said inner wall surfaces a corresponding plurality of pairs of tunnels of rectangular cross-section within said housing, each pair being associated with one of said belts and in which said conveyor belts traverse during the respective straight course runs thereof.

7. The apparatus of claim 6 in which said microwave power source operates at 2450MHz and a power output of about 30KW, the longest side dimension of said tunnel cross-section being substantially 1.7 inches, said tunnels being about 10 inches long.

8. The apparatus of claim 6 in which said microwave power source operates at 915MHz and a power output of about 30KW, the longest side dimension of said tunnel cross-section being substantially 2.7 inches, said tunnels being about 20 inches long.

9. The apparatus of claim 6 in which the said opposed inner wall surfaces are those of a pair of spaced housing side walls, there being a further pair of spaced housing side walls extending between said first-mentioned pair, the means for supporting said belts means a first drum extending between and rotatably supported in said further pair of housing side walls at said one end thereof and adjacent said cavity openings, and a second drum extending between and rotatably supported in said further pair of housing side walls adjacent the other end thereof, said second drum being provided with radial flanges extending between adjacent ones of said belts for maintaining each belt disposed parallel with the others.

10. The apparatus of claim 9 in which said first drum is electrically insulated from the structure of said housing.

11. The apparatus of claim 9 in which said tunnel defining means includes partitions extending inwardly within the housing from the inner surfaces of the first-mentioned pair of housing side walls alongside the straight run courses of said belts, and panels extending between said partitions and disposed substantially parallel to said inner surfaces, said belt straight run courses being disposed intermediate said panels and said inner surfaces, said partitions and panels extending longitudinally of said housing said predetermined length thereof between said drums.

12. The apparatus of claim 11 further comprising a microwave reflector supported in said housing adjacent said first drum adjacent to side of said first drum remote from said one end of said housing and following the contour of said drum in spaced relation therewith.

13. The apparatus of claim 6 further comprising means for separately adjusting the tension in each of said belts.

14. The apparatus of claim 6 in which said conveyor belt means is made of a material which has low-loss characteristics.

* * * * *